United States Patent [19]

Haraguchi et al.

[11] Patent Number: 4,859,382

[45] Date of Patent: Aug. 22, 1989

[54] PROCESS FOR PREPARING CARBON FIBERS ELLIPTICAL IN SECTION

[75] Inventors: Kazutoshi Haraguchi, Matsudo; Eiji Tanigawa, Kawanishi; Kenji Nukina, Kashiwa; Hiroaki Morita, Osaka; Toyohiro Maeda, Tenri, all of Japan

[73] Assignees: Osaka Gas Company Limited, Osaka; Dainippon Ink and Chemicals Inc., Tokyo, both of Japan

[21] Appl. No.: 105,427

[22] PCT Filed: Jan. 22, 1987

[86] PCT No.: PCT/JP87/00040

§ 371 Date: Nov. 16, 1987

§ 102(e) Date: Nov. 16, 1987

[30] Foreign Application Priority Data

Jan. 22, 1986 [JP] Japan ..... 61-12847

[51] Int. Cl.[4] ..... D01F 9/00

[52] U.S. Cl. ..... 264/29.2; 264/83; 264/177.11; 264/177.13; 264/177.18; 264/177.19; 264/211.11; 264/211.15; 264/211.17

[58] Field of Search ..... 264/177.13, 177.11, 264/29.2, 83, 177.18, 177.19, 211.11, 211.15, 211.17

[56] References Cited

U.S. PATENT DOCUMENTS 4,628,001 12/1986 Sadaki et al. ..... 264/29.2

FOREIGN PATENT DOCUMENTS 59-168126 9/1984 Japan .
60-173121 9/1985 Japan .
61-6314 1/1986 Japan .
61-6316 1/1986 Japan .
61-47826 3/1986 Japan .
61-108725 5/1986 Japan .
61-113827 5/1986 Japan .
61-113828 5/1986 Japan .
61-275426 12/1986 Japan .

*Primary Examiner*—Hubert Lorin
*Attorney, Agent, or Firm*—Armstrong, Nikaido, Marmelstein, Kubovcik & Murray

[57] ABSTRACT

A process for preparing a carbon fiber having an elliptical cross section, characterized by the steps of extruding spinnable pitch from a nozzle with an orifice rectangular or otherwise shaped in cross section and having a width/height ratio of more than 1, fully relaxing the molecules orientated by the nozzle on discharge from the nozzle, effecting continuous winding-up to obtain a pitch fiber elliptical in cross section, rendering the fiber infusible and carbonizing the same.

8 Claims, 2 Drawing Sheets

PROCESS FOR PREPARING CARBON FIBERS ELLIPTICAL IN SECTION

TECHNICAL FIELD

The present invention relates to a process for preparing carbon fibers having an elliptical cross section.

BACKGROUND ART

Today carbon fibers are produced chiefly from polyacrylonitrile (hereinafter referred to as "PAN") and pitch as starting materials.

PAN carbon fibers having a tensile strength of at least 300 kg/mm$^2$ are commercially available. These fibers are widely used as base materials for producing high-performance composite materials. However, PAN carbon fibers are relatively low in elastic modulus which is among the important properties required of starting materials for high-performance composite materials. Those commercially available have mostly an elastic modulus of about 20 to about 30 ton/mm$^2$ and those with an elastic modulus exceeding 40 ton/mm$^2$ have not been obtained. The limitation of elastic modulus is attributable to the starting material for producing PAN carbon fibers as known, and is caused inevitably by the crystal growth and crystalline orientation in the interior of carbon fiber. PAN carbon fibers have the further drawback of being costly to manufacture because the carbonization yield is as low as about 50% based on the starting material and stretching is required after completion of the step for infusibility.

On the other hand, pitch-thpe carbon fibers are free of the problems encountered by PAN carbon fibers and thus are expected to be usable as less expensive and high performance materials. Particularly when the fiber is prepared from pitch material hving an optical anisotropy, the crystal growth and crystalline orientation favorably proceed with the rise of temperature (1000° to 3000° C.) in the carbonization of precursor fiber (hereinafter referred to as "pitch fiber"), so that a carbon fiber can be easily produced which has an elastic modulus of 40 ton/mm$^2$ or higher. The starting material used is a residue produced as a by-product in preparation of other materials for use in some other applications and thus is cheaply available. In addition, the carbonization yield is about 90% based on the weight of pitch fiber. For these reasons, the pitch-type carbon fibers have the advantage of being produced at low costs. However, the pitch which is used as a material for spinning (hereinafter referred to as "spinnable pitch") in the preparation of pitch-type carbon fibers has inherent characteristics: (A) the pitch has an extremely low molecular weight as compared with organic polymers commonly used; (B) the pitch extensively vary in molecular weight and molecular structure, and (C) the melting temperature, i.e. spinning temperature is as high as 300° C. or higher. Accordingly the pitch-type carbon fibers suffer problems different from those involved in use of usual organic polymeric materials. For example, the following problems are posed.

(i) Since a high spinning temperature of molten pitch is required, the viscosity widely varies with the temperature, the strength of pitch fiber if far lower than that of usual organic fibers including PAN, and the pitch-type carbon fibers are inferior in properties of stable continuous spinning to other organic polymers.

(ii) The various aspects of cohesion state of molecules (hereinafter referred to as "high-order sectional structure") can be seen when the section of pitch-type carbon fibers is observed. More specifically, molecules may form crystals along concentric circles (so-called onion-type), molecules may form crystals radially of the axis of fiber (radial-type), molecules may be distributed without orientation (random-type) or the interior layers may be of the random-type and the exterior layers may be of the radial-type. The pitch-type fiber is likely to form microscopic flaws such as cracks, voids and the like. Such high-order sectional structure and flaws greatly affect the dynamic properties of carbon fibers. Particularly the presence of flaws significantly reduces the tensile strength and elongation. The frequency of occurrence of high-order sectional structure and flaws is variable depending on the spinning temperature, shearing stress applied to molten pitch, draft ratio of pitch fiber (winding rate/discharge rate), atmosphere temperature of the relaxing part and insert stretched solidifying part and like usual spinning conditions and properties of spinnable pitch. In view of said variations, these various parameters need to be strictly controlled to make uniform the quality of carbon fibers.

Accordingly in order to produce high-performance pitch-type carbon fibers with stability, the quality-fluctuating factors previously noted need to be eliminated as much as possible. The advent of new technique for fulfilling this objective is strongly desired.

DISCLOSURE OF THE INVENTION

In view of the above-mentioned state of the art, we conducted extensive research and found that the technical problems of the type previously described can be substantially overcome when spinnable pitch is extruded from a nozzle having an orifice of specific shape, the molecules oriented by the nozzle are fully relaxed on discharge from the nozzle, the extruded pitch is continuously wound up, and the resulting pitch fiber elliptical in cross section, is rendered infusible and carbonized. That is to say, the present invention provides a process for preparing a carbon fiber having an elliptical cross section, characterized by the steps of extruding spinnable pitch from a nozzle with an orifice rectangular or non-circularly shaped in cross section and having a width/height ratio of more than 1, fully relaxing the molecules orientated by the nozzle on discharge from the nozzle, continuously winding up the extruded pitch to obtain a pitch fiber elliptical in cross section, rendering the fiber infusible and carbonizing the same.

In the present invention, when the fiber is graphitized in the carbonization step, a graphite fiber is obtained. Thus the term "carbonization" appearing herein is used to express the concept encompassing graphitization and the term "carbon fiber" used herein is intended to include graphite fiber.

It is preferred to obtain the pitch to be used as spinnable pitch in the present invention by thermal condensation polymerization of the pitch material in an inert gas stream. The pitch material can be any of petroleum pitch, coal pitch and pitch produced as residue from an organic compound by thermal decomposition. Preferred pitch materials are those having a softening point of 280° to 325° C. (as measured with a softening point-measuring device manufactured by Metller Co., Switzerland). Particularly when coal pitch such as coal tar or coal tar pitch is used as the starting material, the spinning properties of the fiber can be further improved by heat-treating the pitch material in the presence of an aromatic reducing solvent at 350° to 500° C. as disclosed in Japanese Unexamined Patent Publication No. 88016/1982. The kind of spinnable pitch is not specifically limited as long as it can be spun.

The present invention will be described below in detail with reference to the accompanying drawings.

The pitch fiber having an elliptical cross section is produced by extruding spinnable pitch from a nozzle having an orifice rectangular, slit-shaped or otherwise shaped in cross section with a width/height ratio of more than 1, at a temperature at which the spinnable pitch exhibits a good spinnability (which temperature can be experimentally determined with ease according to the kind of pitch), fully relaxing the molecules orientated in the extruded pitch by the nozzle on discharge from the nozzle and continuously winding up the fiber.

FIGS. 1 to 4 show a few examples of orifice shapes of nozzle to be used in the present invention.

Figure 1:
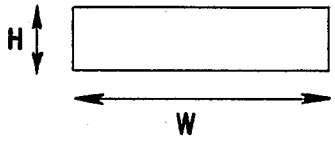
FIGS. 1 to 5 are schematic views showing typical examples of nozzle to be used in the present invention.
Figure 2:
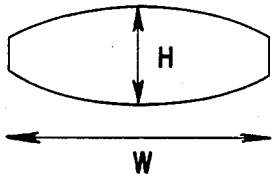
Figure 3:
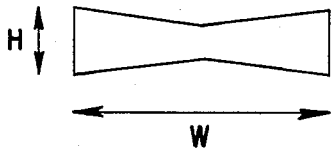
Figure 4:
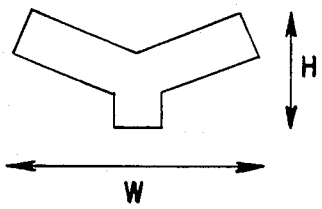
Figure 5:
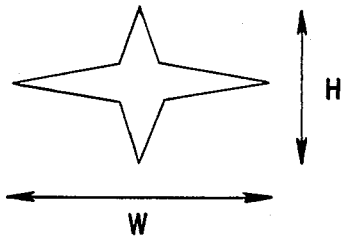

FIG. 1 shows a nozzle with an orifice rectangular in cross section and having a ratio of width (W) to height (H), i.e. W/H ratio, $>1$. FIG. 2 shows an nozzle having an orifice of different shape in cross section with the two longer sides continuously bent outwardly and bulged. FIG. 3 shows a nozzle having an orifice of different shape in cross section with the two longer sides inwardly bent. FIG. 4 shows a nozzle having an orifice of different cross section with $W/H>1$, i.e., irregular Y-shaped cross section. FIG. 5 shows a nozzle having an orifice of different cross section with $W/H>1$, namely irregular cruciform cross section. The orifice shape of nozzle in the present invention is in a ratio of width (W) to height (H), i.e. W/H ratio, of more than 1, preferably in the range of more than 1 to 10, more preferably more than 1 to 5, and need not be elliptical. The width and the height of nozzle orifice used herein denote maximum values. It is suitable that the cross sectional area of such orifice which is not specifically limited be about $5\times10^{-1}$ to about $5\times10^{-3}$ mm$^2$, more preferably about $10^{-1}$ to about $10^{-2}$ mm$^2$ to prevent the formation of flaws such as longitudinal fractures and cracks.

The term "relaxing of pitch molecules oriented in the spinnable pitch" used herein refers not to the phenomenon that the extruded pitch melt is thinned and solidified into a fiber during spinning operation while retaining the cross-sectional shape resembling the shape of nozzle orifice, but the phenomenon that the pitch melt changes the initial shape formed in comformity with the shape of nozzle into an elliptical shape due to thermal motion of pitch molecules and because of the surface tension of thread during a period of time from immediately after discharge of melt from the nozzle until the slenderizing and/or solidification. The relaxation in the present invention is fully effected until the cross section is given an elliptical shape having longer and shorter two sides correspondingly formed on the basis of W/H ratio $>1$ of nozzle orifice used. The relaxation of the molecules oriented within the pitch upon extrusion from the nozzle is achieved in principle by elevating the spinning temperature, especially the temperature of the pitch melt at the time when the pitch melt is discharged from the nozzle. However, if the spinning temperature is raised by simply elevating the temperature of pitch melt, the stable continuous spinning frequently becomes difficult because of generation of gas, reduction of spinnability and other factors. Accordingly it is desirable to devise the structure of nozzle so that the pitch melt can be locally heated at a position close to the nozzle mouth or at the nozzle mouth before spinning, or that the pitch melt just discharged from the nozzle can be locally heated. However, the means for relaxation of molecules is not limited insofar as the relaxation is accomplished.

The thread with the pitch molecules fully relaxed is continuously wound up into a pitch fiber having an elliptical cross section. The cross-section area of pitch fiber elliptical in cross section, which is not specifically limitative, is preferably about $3\times10^{-5}$ to about $3\times10^{-4}$ mm$^2$ in order to make elliptical the cross-sectional shape of fiber and to prevent the formation of longitudinal fractures, cracks and like flaws in the carbon fiber eventually obtained.

According to the present invention, the sectionally elliptical pitch fiber obtained as above is processed by conventional methods, for example, by being heated at a temperature of 280° to 440° C. in an oxygen-containing atmosphere to render the fiber infusible and then further heated to about 1000° to about 2000° C. in an atmosphere of nitrogen, carbon dioxde, argon or the like in the case of carbonization, or to about 2000° to about 3000° C. in an atmosphere of argon or the like in the case of graphitization.

EFFECTS OF THE INVENTION

According to the present invention, the following remarkable effects are achieved.

(i) The sectionally elliptical carbon fiber eventually obtained is substantially free of cracks, longitudinal fractures and like microscopic flaws.

(ii) The sectionally elliptical carbon fiber of the present invention has a tensile strength significantly greater than a sectionally circular carbon fiber having the same sectional area.

(iii) While generally variable with the characteristics of spinnable pitch, spinning conditions, high-order sectional structure, cross section of fiber or like factors, the magnitude of tensil strength of pitch-type carbon fiber is gradually or sharply diminished with the increase in the sectional area of the fiber. Consequently the fact that the sectionally elliptical carbon fiber of the invention has remarkable strength characteristics means that the continuously spinning property is easily accomplished without having to reduce the sectional area of fiber to achieve the same tensile strength.

(iv) The carbon fiber of the present invention having an elliptical cross section is greater in surface area per unit volume so that the high dynamic properties of carbon fiber are fully exhibited when combined with another material to form a composite. Therefore, the carbon fiber of the invention is particularly suitable as a material for producing a composite material.

EXAMPLE

The feature of the invention will be explained below with reference to the following examples together with reference and comparison examples.

REFERENCE EXAMPLE 1

A mixed solution of 1 part by weight of coal tar pitch having a softening point of 120° C. and containing 0.20% by weight of quinoline-insoluble component and 37% by weight of benzene-insoluble component and 2 parts by weight of hydrogenated heavy anthracene oil was heated with stirring in an autoclave at 430° C. for 60 minutes, and then the hot mixture was passed through a filter-press. The hydrogenated heavy anthracene oil was removed from the filtrate by heating at 300° C. under a reduced pressure to obtain reduced pitch.

In a reactor equipped with a gas-inlet pipe, a thermocouple, a stirrer and a distillate-outlet pipe was placed 50 Kg of reduced pitch and it was treated at 410° to 480° C. for 4 hours while introducing nitrogen gas to remove low-molecular weight components and to effect heat condensation polymerization.

The resultant pitch had a softening point of 313° C. (measured by a softening point measuring apparatus made by Metller Co.) and contained 38% by weight of quinoline-insoluble component and 5.1% by volume of optically isotropic component.

EXAMPLE 1

The heat condensation polymerized pitch prepared in Reference Example 1 was extruded from a nozzle with an office having rectangular cross section of specific H and W as shown in FIG. 1 at a nozzle temperature of softening point plus 55° C., and the extruded pitch was subjected to relaxation of the oriented pitch molecules contained therein by uniformly heating the zone below the orifice so that the extruded pitch became finer (solidified) at the level 7 mm lower than the surface of the orifice, and then wound up to produce pitch fibers having elliptic cross section of desired fiber cross-sectional area. The resulting pitch fibers were treated in the air at 310° C. to render them infusible and then heated in $N_2$ gas at 1200° C. for 10 minutes to produce carbon fibers having elliptic cross section.

The cross-sectional area, content of flaws such as cracks, longitudinal fractures and physical properties of the carbon fibers thus obtained are shown in Table 1.

TABLE 1

| Sample No. | Shape of nozzle (mm) W | H | depth | Sectional area ($mm^2$) | Content of flaws (%) | Strength ($kg/mm^2$) | Elastic modulus ($ton/mm^2$) | Sectional area of nozzle ($mm^2$) |
|---|---|---|---|---|---|---|---|---|
| 1 | 0.5 | 0.07 | 0.4 | $85 \times 10^{-6}$ | 0 | 304 | 18.1 | $3.5 \times 10^{-2}$ |
| 2 | 0.5 | 0.07 | 0.4 | $129 \times 10^{-6}$ | 0 | 296 | 17.5 | $3.5 \times 10^{-2}$ |
| 3 | 0.3 | 0.11 | 0.4 | $88 \times 10^{-6}$ | 0 | 288 | 17.3 | $3.3 \times 10^{-2}$ |
| 4 | 0.3 | 0.11 | 0.4 | $141 \times 10^{-6}$ | 0 | 279 | 16.8 | $3.3 \times 10^{-2}$ |

EXAMPLE 2

Pitch fibers having elliptic cross section were produced with use of the heat condensation polymerized pitch prepared in Reference Example 1, by extruding the pitch through the respective nozzle orifice having different cross section as shown in FIGS. 3 to 5 (maintained at a temperature of softening point plus 50° C.) while heating the pitch at a temperature of softening point +70° C. immediately before the nozzle, effecting the relaxation immediately after the extrusion and conducting winding up to thereby give pitch fibers having elliptic cross section. The resulting pitch fibers were treated in the air at 310° C. to render them infusible and heated in $N_2$ gas to produce carbon fibers having elliptic cross section.

The cross-sectional area, flaw contents and physical properties of the carbon fibers thus produced are shown in Table 2.

TABLE 2

| Sample No. | Shape Nozzle | W (mm) | H (mm) | Sectional area ($mm^2$) | Content of flaws (%) | Strength ($kg/mm^2$) | Elastic modulus ($ton/mm^2$) | Sectional area of nozzle ($mm^2$) |
|---|---|---|---|---|---|---|---|---|
| 5 | FIG. 3 | 0.30 | 0.14 | $96 \times 10^{-6}$ | 0 | 302 | 18.1 | $3.3 \times 10^{-2}$ |
| 6 | FIG. 4 | 0.30 | 0.15 | $102 \times 10^{-6}$ | 0 | 287 | 17.2 | $3.4 \times 10^{-2}$ |
| 7 | FIG. 5 | 0.25 | 0.25 | $95 \times 10^{-6}$ | 0 | 293 | 17.5 | $1.4 \times 10^{-2}$ |

COMPARISON EXAMPLE 1

Carbon fibers having circular cross section were produced with use of the heat condensation polymerized pitch prepared in Reference Example 1 by extruding through nozzle orifices having circular cross-section of 0.25 mm in diameter at an extrusion temperature of softening point +40° C. (sample No. 8) or softening point +55° C. (sample No. 9), and then winding and subjecting to treatment for rendering them infusible and to carbonization treatment in the same manner as in Example 1.

The cross-sectional area, flaw content and physical properties of the resulting carbon fibers are shown in Table 3.

TABLE 3

| Sample No. | Cross-sectional area ($mm^2$) | Flaw content (%) | Strength ($kg/mm^2$) | Elastic modulus ($ton/mm^2$) |
|---|---|---|---|---|
| 8 | $95 \times 10^{-6}$ | 35% (crack) | 185 | 14.8 |
| 9 | $131 \times 10^{-6}$ | 15% (void) | 226 | 16.2 |

It is apparent that, when relaxation of oriented pitch molecules is not carried out after extrusion, the strength and elastic modules of the resulting fibers become poor due to the flaws formed.

REFERENCE EXAMPLE 2

Figure 6:
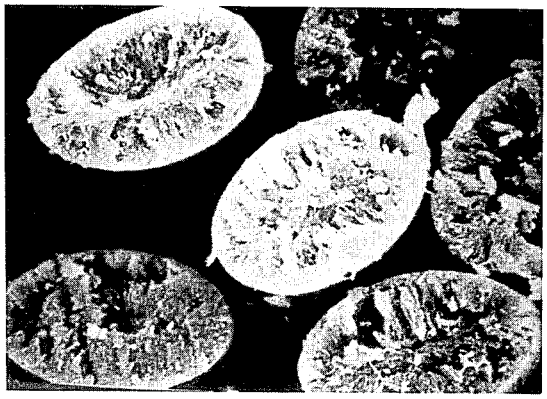
FIGS. 6 and 7 are scanning electron micrographs showing the cross section of carbon fiber obtained in working examples.
Figure 7:
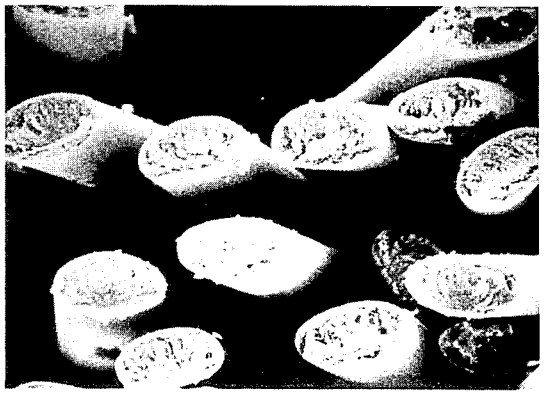

Scanning electron micrographs of the carbon fiber produced from Sample No. 3 in Example 1 and of that produced from Sample No. in Example 2 are shown in FIG. 6 (about 3000×magnification) and in FIG. 7 (about 1200×magnification), respectively.

We claim:

1. A process for preparing a carbon fiber having an elliptical cross section and substantially free of microscopic flaws, comprising the steps of extruding spinnable pitch from a nozzle with an orifice being rectangular or non-circularly shaped in cross section and having a width/height ratio of more than 1, fully relaxing the molecules in the extruded pitch oriented by the nozzle on discharge from the nozzle, effecting continuous winding-up to obtain a pitch fiber elliptical in cross section, rendering the fiber infusible and then carbonizing said fiber.

2. A process according to claim 1 wherein the orifice of the nozzle is rectangular or otherwise shaped in cross section and having a width/height ratio of between more than 1 and 10.

3. A process according to claim 1 wherein the cross-sectional area of the nozzle orifice is rectangular or otherwise shaped and is $5\times10^{-1}$ to $5\times10^{-3}$ $mm^2$.

4. A process according to claim 1 wherein the softening point of the spinnable pitch is 280° to 325° C.

5. A process according to claim 1 wherein the pitch melt is rendered infusible in an oxygen-containing atmosphere at 280° to 440° C.

6. A process according to claim 1 wherein the carbonization is effected in an atmosphere of an inert gas at 1000° to 2000° C.

7. A process for preparing a graphite fiber having an elliptical cross section and substantially free of microscopic flaws, comprising the steps of extruding spinnable pitch from a nozzle with an orifice being rectangular or non-circularly shaped in cross section and having a width/height ratio of more than 1, fully relaxing the molecules in the extruded pitch oriented by the nozzle on discharge from the nozzle, effecting continuous winding-up to obtain a pitch fiber elliptical in cross section, rendering the fiber infusible and then graphitizing said fiber.

8. A process according to claim 7 wherein said graphitization is carried out in an argon atmosphere at 2000° to 3000° C.

* * * * *